US009500998B2

(12) United States Patent
Deprez et al.

(10) Patent No.: US 9,500,998 B2
(45) Date of Patent: Nov. 22, 2016

(54) LIQUID TONER DISPERSION HAVING A SPECIFIED RELATIVE CONDUCTIVITY AND RELATIVE VISCOSITY AND PROCESS FOR TRANSFERRING AN IMAGE TO A SUBSTRATE

(71) Applicant: Xeikon IP B.V., Eede (NL)

(72) Inventors: Lode Erik Dries Deprez, Wachtebeke (BE); Wim Libaers, Boortmeerbeeck (BE); Werner Jozef Johan Op de Beeck, Putte (BE); Kurt Gustaaf Maria Mampaey, Rumst (BE); Mathias Jo Bert van Remortel, Wechelderzande (BE)

(73) Assignee: Xeikon IP B.V., Eede (NL)

( * ) Notice: Subject to any disclaimer, the term of this patent is extended or adjusted under 35 U.S.C. 154(b) by 0 days.

(21) Appl. No.: 14/782,499

(22) PCT Filed: Apr. 4, 2014

(86) PCT No.: PCT/EP2014/056871
§ 371 (c)(1),
(2) Date: Oct. 5, 2015

(87) PCT Pub. No.: WO2014/162004
PCT Pub. Date: Oct. 9, 2014

(65) Prior Publication Data

US 2016/0041506 A1 Feb. 11, 2016

(30) Foreign Application Priority Data

Apr. 5, 2013 (NL) ..... 2010581

(51) Int. Cl.
*G03G 15/11* (2006.01)
*G03G 15/10* (2006.01)
*G03G 9/13* (2006.01)

(52) U.S. Cl.
CPC ..... *G03G 15/11* (2013.01); *G03G 9/132* (2013.01); *G03G 15/104* (2013.01)

(58) Field of Classification Search
CPC ..... G03G 15/104; G03G 15/11; G03G 9/132
See application file for complete search history.

(56) References Cited

U.S. PATENT DOCUMENTS 5,061,583 A * 10/1991 Zwadlo ..... G03G 9/12 430/103
6,088,560 A * 7/2000 Zenk ..... G03G 15/0121 222/DIG. 1
6,287,741 B1 * 9/2001 Marko ..... G03G 9/125 430/115

(Continued)

FOREIGN PATENT DOCUMENTS

GB 1353207 5/1974
JP 5879276 A 5/1983

(Continued)

*Primary Examiner* — David Gray
*Assistant Examiner* — Trevor J Bervik
(74) *Attorney, Agent, or Firm* — The Webb Law Firm

(57) ABSTRACT

Disclosed is a liquid toner dispersion which has a relative low shear viscosity between 1.25 and 225 and a relative conductivity between 0.3 and 30. The liquid toner dispersion includes toner particles in a non-polar carrier liquid, as well as a dispersing agent. This liquid toner dispersion is used in a digital printing process including adding dispersing agent during recycling of excess liquid toner dispersion remaining on a development member after patterned transfer of liquid toner dispersion to the imaging member.

16 Claims, 3 Drawing Sheets

(56) References Cited

U.S. PATENT DOCUMENTS

| | | | | |
|---|---|---|---|---|
| 8,630,568 | B2 * | 1/2014 | Yoshie | G03G 15/10 399/238 |
| 2005/0160938 | A1 | 7/2005 | Moudry et al. | |
| 2008/0317489 | A1 * | 12/2008 | Kamoda | G03G 15/105 399/57 |
| 2009/0162779 | A1 * | 6/2009 | Nair | C09B 67/0013 430/137.14 |
| 2011/0103840 | A1 | 5/2011 | Oda et al. | |
| 2011/0249990 | A1 | 10/2011 | Izawa et al. | |

FOREIGN PATENT DOCUMENTS

| | | | |
|---|---|---|---|
| JP | 4220498 | A | 8/1992 |
| JP | 2009300875 | A | 12/2009 |
| NL | 2010573 | | 10/2014 |
| NL | 2011064 | | 1/2015 |
| NL | 2011381 | | 3/2015 |
| NL | 2011955 | | 6/2015 |
| NL | 2012086 | | 7/2015 |

* cited by examiner

LIQUID TONER DISPERSION HAVING A SPECIFIED RELATIVE CONDUCTIVITY AND RELATIVE VISCOSITY AND PROCESS FOR TRANSFERRING AN IMAGE TO A SUBSTRATE

CROSS-REFERENCE TO RELATED APPLICATIONS

This application is the United States national phase of International Application No. PCT/EP2014/056871 filed Apr. 4, 2014, and claims priority to Netherlands Patent Application No. 2010581 filed Apr. 5, 2013, the disclosures of which are hereby incorporated in their entirety by reference.

FIELD OF THE INVENTION

The invention relates to a digital printing process for transferring an image to a substrate, wherein liquid toner dispersion comprising toner particles in a substantially non-polar carrier liquid is fed from a toner container to a development member, charged and then transferred to a further member according to a desired pattern under the impact of an electric field, and wherein liquid toner dispersion remaining on the development member is removed thereof and recycled into the toner container.

The invention further relates to the use and control of a liquid toner dispersion for such a digital printing process.

BACKGROUND OF THE INVENTION

Digital printing apparatus using liquid development dispersion—also known as liquid toner—are known from US patent application publication no. 2011/0249990. The known digital printing apparatus comprises a feed member, a development member, development member cleaning means, and an image carrying member, these member being preferably rollers; the feed member being arranged to transfer a quantity of liquid toner from a toner container onto the toner member; and the development member being arranged to transfer a portion of the quantity of liquid toner onto the image carrying member in accordance with a charge pattern sustained on a surface of said image carrying member. A liquid toner residue, also referred to as an excess liquid toner dispersion, remains on (the surface of) the development member after the image wise transfer of the liquid toner from the development member to a further member, particularly the imaging member.

In digital printing systems of this kind, it is necessary to remove the liquid toner residue that remains on the surface of the development member after contact with the imaging roller. Any liquid toner residue that remains on the surface of the imaging member after contact with a transfer roller of after contact with a substrate needs to be removed as well. More generally, it may be desirable to remove a residue remaining on any member of the apparatus. It is observed that these highly concentrated and therefore highly viscous compacted toners are not easily decompacted and removed from such members. Thus, the removal of such a residue can be quite challenging and therefore it is better to try to prevent such situation from happening.

Particularly, toner particles in the liquid toner dispersion tend to form lumps in the dispersion resulting in a liquid with a non-uniform distribution of toner particles. This is called caking and often results in an increase of the viscosity of the liquid dispersion. This viscosity increase is significant and could be a tenfold increase or even more.

Liquid toner dispersion that shows caking cannot be used for printing as such and needs to be treated first in order to re-obtain a homogeneously dispersed liquid toner which has similar conductivity and viscosity properties as the starting liquid toner dispersion. The treatment process therefore needs to be monitored and arranged such that the properties of the liquid toner dispersion in the toner container remain appropriate and should bring the toner dispersion in such a condition that the reoccurrence of caking is maximally suppressed. One example of a process thereof is known from US2011/0103840A1 that is included herein by reference.

It is thought that caking is the result of toner particles that come so close into each other's neighbourhood on the developing member, so that they start to feel each other's presence and start interacting with each other. Caking can also be the result of injecting charge and applying high shearing forces which are typically present when a thin layer of liquid toner dispersion passes through a very narrow gap between two (rotating) members of the printing apparatus or huge (microsized) mechanical interaction like a cleaning blade scraping on a rotating surface.

The removal of the liquid toner residue starts then to be problematic. As a result, liquid toner residue could remain on the development member or a scraper blade, which constitutes a contamination and may lead to a non-uniform distribution of fresh toner dispersion resulting in a ghost image, density fluctuations and or image quality that is not perfect, in other words incorrect. The cleaning performance of the development member also is then negatively influenced and failing may occur. Specific examples of issues are density instability and incorrect reproduction of fine lines or background. Removal of the toner residue by a removal device may reduce the issue, but is known to solve the issue incompletely. It is therefore a major problem to solve the caking issue, without giving rise to a reduced printing quality.

SUMMARY OF THE INVENTION

According to a first aspect, the invention relates to a liquid toner dispersion comprising toner particles in a substantially non-polar carrier liquid, characterized by a relative conductivity between 0.5 and 30, and a relative low shear viscosity between 1.25 and 225, wherein:

- the relative conductivity (RC) is defined as a ratio of the liquid toner dispersion conductivity (TC) and the conductivity of a supernatant liquid (SNC) obtained in centrifugation of the liquid toner dispersion,
- the relative low shear viscosity (RLSV) is defined as the low shear viscosity of of a liquid toner dispersion and and the low shear viscosity of the supernatant liquid.

According to a second aspect, the invention relates to the use of the liquid toner dispersion of the invention, wherein the liquid toner dispersion is fed to a development member, charged and then transferred to a further member according to a desired pattern under the impact of an electric field, for the prevention of caking of liquid toner dispersion remaining on the development member in the transfer step.

According to a third aspect, the invention relates to a digital printing process for transferring an image to a substrate, wherein liquid toner dispersion comprising toner particles in a substantially non-polar carrier liquid is fed from a toner container to a development member, charged and then transferred to a further member according to a desired pattern under the impact of an electric field, and wherein excess liquid toner dispersion remaining on the development member is removed thereof and recycled into the toner container, wherein the process further comprises the step of maintaining the liquid toner dispersion in the toner container, so as to ensure that the liquid toner dispersion therein and as fed to the development member is the liquid toner dispersion of the invention.

It was found by the inventors in investigations leading to the present invention, that caking problems can be prevented and/or controlled and a good printing performance maintained by operation in a specific operating window for relative conductivity and relative low shear viscosity (hereinafter also abbreviated as RC and RLSV respectively) for the liquid toner dispersion during printing. If a liquid toner dispersion is kept within the specified ranges, the formation of caking can be drastically reduced without any negative influence on printing performance (image quality, fusing and transfer efficiency). If a liquid toner dispersion is used that exceeds the upper limit of the relative viscosity range, caking typically occurs and also kinetical problems are observed in terms of the electrophoretic response that is slowing down. If the used liquid toner dispersion has a RLSV below the lower limit for the relative viscosity range, formation of a film of the liquid toner dispersion on the development member turns out inadequate. Also dripping or formation of rivulets at the entrance of the development nip resulting in a noisy image may occur.

If the RC is below the lower limit for RC problems may occur with the transfer of the dispersion from the development member to the further member, particularly a photoconductor gave issues and fusing. A too low RC translates into the formation of an emulsion rather than a fused film. Also rivulets at the entrance of the development nip may occur resulting in a noisy image and full density areas, which are not equally filled. A too low RC is an indication that too much free dispersing agent is present which may results in a too low charged toner (or a toner losing its charge very quickly), resulting in the transfer problems and in an reduced coalescence behaviour resulting in fusing (hot offset) and adhesion problems. This coalescence disturbing behaviour probably could be due to the increased dispersion stability of the toner particles Such transfer transfer problems may also occur, if the RC is above the upper limit for RC. This can happens when the toner particle is too conductive on its own (i.e. a high toner conductivity (TC)). Such high toner conductivity is understood to limit the chargeability of the toner particle and thus the transfer efficiency. Hence, these two independent parameters relate to different printing and process failures. It therefore makes sense to characterize the liquid toner dispersion on the basis thereof.

The liquid toner dispersion may be further characterized by the (electrical) conductivity of the supernatant liquid (also abbreviated to as SNC or as liquid conductivity). This conductivity turns out to be a suitable absolute measure in relation to fusing issues. Also transfer problems may occur and image defects such as sharpness of the image edges may occur. A too high SNC value is an indication that too much free dispersing agent is present which may results in a too low charged toner resulting in the transfer problems and in an reduced coalescence behaviour resulting in fusing problems. Its meaning overlaps with the relative conductivity (RC), but its use may be more simplistic. Use could also be made of the SNC rather than the RC, as this involves less measurement. The liquid conductivity suitably has a value of less than 20 pS/cm, more preferably less than 17 pS/cm, or even less than 15 pS/cm. However, it is observed that the suitability of the liquid conductivity as such is reduced, if the low shear viscosity of the supernatant liquid gets too high. One could further imagine an optimized algorithm, wherein a function is based on a product of the conductivity and the low shear viscosity of the supernatant liquid. This all may be implemented in the process software.

In the process of the invention the maintenance of the liquid toner dispersion suitably comprises the step of the addition of dispersing agent. This dispersing agent may be added directly to the toner container, but alternatively or additionally also at another location in the process. One other location is for instance to add a composition of dispersing agent to the excess liquid toner dispersion, and therewith obtain a better removal from the development member.

The liquid toner dispersion as used in the invention preferably comprises toner particles in with an average diameter in the range of 0.5 to 2.5 micrometers. This type of toner particles is suitable for processing and results in an appropriate resolution of the resulting image.

The toner particles of the liquid toner dispersion more preferably comprise pigment mixed with a binder resin and a dispersing agent. A variety of pigments and binder resins can be used in accordance with the invention. The dispersing agent is suitably of the hyper-dispersant type comprising an anchor group for binding to a toner particle and stabilizing groups coupled to said anchor group for stabilizing said toner particle in the carrier liquid. The liquid toner dispersion may further comprise additives, such as free dispersing agent, spacer agent and any other additives.

Suitably, the liquid toner dispersion is stabilized, at least primarily, on the basis of steric stabilisation, rather than an electrical stabilisation. Such steric stabilisation is obtained for instance in the choice of the dispersing agent. If a charging agent such as a metal salt were chosen as dispersing agent, the stabilisation of the dispersion would be primarily realized by electrical repulsion. Such a liquid toner dispersion has another behaviour and moreover has different conductivity values than those in accordance with the invention. Rather, if a dispersing agent is chosen comprising groups that create steric hindrance, a steric stabilisation is obtained. Such groups creating steric hindrance are for instance organic chains, suitably with side chains. The chains may be provided with polar groups, such as carboxyl-groups and/or amino-groups. Suitable groups are for instance polymers of (hydroxylated) fatty acids and polyolefines. In one particularly preferred embodiment, the liquid toner dispersion of the invention is intrinsically uncharged, and gets charged only by means of a charging treatment, such as a corona treatment.

In a preferred embodiment, the excess liquid dispersion remaining on the development member after transfer to the imaging member, is again decharged in a decharging step. This is further described in the non-prepublished application NL2010573 in the name of Applicant that is herein included by reference.

More preferably, the dispersing agent is herein of the so-called hyper-dispersant type. Such a dispersing agent is coupled or anchored to the particle with several functional groups and is known to provide optimum properties. Therewith, a docking interaction of the dispersing agent with the toner surface is realized, together with the presence of chemical moieties that provide dispersion stability (so called tails).

The maintenance of the liquid toner dispersion in the toner container typically comprises the addition of toner concentrate, carrier liquid, a solution of dispersing agent in carrier liquid and/or the recycled liquid toner dispersion. This addition process may occur in a series of tanks, so as to reduce the number of streams into the toner container and/or to obtain a better pre-mixing. Furthermore, use could be made of a cycle, wherein a portion of the liquid toner dispersion in the toner container is fed into a mixing tank and thereafter returned to the toner container. The arrangement is suitably optimized in dependence of the printing volume and the size of the printing apparatus. Sensors may be available for control of the process. It is particularly deemed suitable to provide a level sensor for the level of liquid toner dispersion in the toner container, as well as a sensor for sensing the recycled toner dispersion, such as its flow rate, its concentration of toner particles and viscosity.

Also appropriate means can be present to measure the solid content, conductivity and viscosity of the liquid toner dispersion in the container. Thereto, the system suitably comprises a viscosity sensor arranged for measuring the viscosity of the liquid toner dispersion. The controller may then be configured for controlling the adding means based on the measured viscosity. Alternatively or in addition, the system comprises a conductivity sensor arranged for measuring the conductivity of the liquid toner dispersion, wherein the controller is configured for controlling the adding means based on the measured conductivity. Suitably, the liquid toner dispersion concentration is held within a tolerance limit. Such tolerance limit is for instance 5%, more preferably even around 2%. Such a low limit is beneficial so as that the printer settings can be optimized.

According to a first embodiment, the digital printing system comprises a first container (or reservoir) adapted for collecting the excess liquid toner solution, wherein the adding means are arranged for adding an amount of dispersing agent in the first reservoir. This first reservoir is typically relatively small and may be provided with a suitable mixing means for mixing the excess liquid toner solution with an amount of dispersing agent. The system further comprises a second reservoir, typically larger than the first reservoir, adapted for mixing the excess liquid toner solution in which the amount of dispersing agent is added, with carrier liquid and/or toner concentrate. To that end there are provided carrier liquid adding means arranged for adding an amount of carrier liquid in the second reservoir, and toner concentrate adding means arranged for adding an amount of toner concentrate in the second reservoir. Typically, the second reservoir is connected to the main reservoir (or toner container) for returning recycled toner dispersion, said main reservoir comprising a feeding means for feeding a developer roller. Such a system has the advantage that caking in the collected excess liquid toner dispersion can be adequately mechanically addressed in the first reservoir, whilst the overall solid content, conductivity and viscosity can be brought to a suitable level in the second reservoir.

According to a second embodiment, the digital printing system comprises a first container (or reservoir) adapted for collecting the excess liquid toner dispersion. Adding means are provided to add dispersing agent, toner concentrate and carrier liquid into this first container. Moreover, also liquid toner dispersion from the (main) toner container may be added into this first container. Stirring means are present for appropriate mixing. The resulting liquid toner dispersion is again added into the main toner container. Such a system has the advantage of being sufficiently concise and more economical in terms of pumps, vessels and sensors.

The digital printing process particularly comprises the transfer of a development member to a photoconductor member (also referred to as an imaging member). The liquid toner dispersion is thereto charged at the development member, for instance by means of a corona treatment. Furthermore, the imaging member carries a latent image corresponding to the image to be printed on the substrate, which latent image is defined by the patterned application of voltages to said imaging member. The liquid toner dispersion may be transferred from the imaging member to the substrate or alternatively to one or more intermediate members. In a final step, suitably carried out at the substrate, the liquid toner dispersion will be transformed into a film—in accordance with the image to be printed—by means of a fusing treatment, which can be a non contact or contact fusing method but more preferably a non-contact fusing followed by an non contact fusing step. During the fusing step the liquid toner dispersion is separated in a liquid carrier rich phase and a toner particles rich phase. The toner particle rich phase adheres to the substrate. If this separation is not sufficiently fast and/or effective, the liquid toner dispersion will typically not coalescence. It typically remains more or less stable at elevated temperature to form an emulsion. As a consequence, adhesion of the toner particles onto the substrate—and thus the fusing quality—will be very poor. This may occur if RC is below lower limit of RC or SNC is above upper limit for SNC.

Liquid toner dispersion or remaining portions thereof (wherein the concentration of toner particles typically deviates from that in the toner container, hereinafter also referred to as excess liquid toner dispersion) are removed from one or more members, such as the development member and the imaging member and recycled into the toner container. The members used in the digital printing process are suitably rollers, but the use of one or more belts or blankets moving around a plurality of rollers is not excluded. Preferably, a discharging treatment is applied to the excess liquid toner dispersion. Such a discharging treatment is not merely beneficial for the removal of the toner residue, but moreover enables an easy recycling of the excess liquid toner dispersion The addition of dispersing agent to maintain the relative conductivity and viscosity ranges for the liquid toner dispersion may be performed in several ways. In one embodiment, the dispersing agent is added to the excess liquid toner dispersion via a further member that is rotational contact with the development member at a stage downstream of the transfer to the image member. The dispersing agent is herein typically added as a solution in carrier liquid, from specific addition means, as specified in the non-prepublished application NL2011381 in the name of Applicant, which is included herein by reference. In another embodiment, the dispersing agent is added to the toner container. The dispersing agent can herein be added as a pure product or as a dilution of the pure dispersing agent in carrier liquid. Further additives besides the dispersing agent, such as a spacer agent, can be also added simultaneously.

DEFINITIONS

In the context of the present invention, the liquid toner is a dispersion of toner particles in a carrier liquid. The toner particles, according to this invention, comprise coloured particles (also called ink particles or pigment) and a binder resin although non pigmented resin systems also can be used containing a phosphor or taggant or UV active material. Typically, the diameter of the toner particles is about 0.5 to 2.5 μm. The toner particles have a concentration of about 40-95% of binder resin. The binder resin is a polymer, preferably transparent, that embeds the ink particles. Preferably, a polyester resin is used as binder resin. Also other types of resin having a very low or no compatibility with the carrier liquid and dispersing agent can be used. Preferably, the resin has a high transparency, provides good colour developing properties and has a high fixing property on the substrate. The carrier liquid according to the invention, can be any suitable liquid as is known in the art, and may be silicone fluids, hydrocarbon liquids, mineral oils, oils chemically derived from vegetable oil and vegetable oils or any combination thereof.

Pigment for use in toner particles is known in the art. More particularly, use is for instance made of organic pigments and/or carbon black. Examples are cyan pigments, magenta pigments, yellow pigments and black pigments. As known in the art, such pigments are referred to according to a C.I. naming convention, and referred to as PB, PR, PY and PBlack respectively with a number indicated the chosen pigment, for instance PB15, PY74, PBlack 7 etc.

In the liquid toner dispersion of the invention, the dispersing agent is—at least partly—bound to the toner particles, either chemically or physically. Additional 'free' dispersing agent may be present in the dispersion, but its concentration is suitably low. The pigment is typically melt mixed with the binding resin and optional other ingredients such as waxes, plasticizers and charging additives into a pre-dispersion. The melt mixing preferably is carried out by means of extrusion to form the toner particle. Thereafter, the toner particle is treated to provide suitably dimensions, for instance by dry milling. The toner particles are then mixed with carrier liquid and dispersing agent into the liquid pre-dispersion, which is thereafter further processed, for instance by fluid milling like bead milling.

Typically, during the printing process a certain amount of carrier liquid is lost because it is highly unlikely that one prints continuously 100% page coverage all the time for all colours. Typically, the viscosity of the excess liquid developing dispersion is increased compared to the viscosity of the starting, i.e. 'fresh' liquid developing dispersion. The increase of the viscosity is due to the loss of carrier liquid and dispersing agent and due to caking. Caking causes a structural change in the liquid developing dispersion and has a significant contribution to the increase of viscosity of the excess liquid toner dispersion. Typical commercially available carrier liquids are Isopar L, Isopar M and Isopar V and higher boiling point Isopars from Exxon, white mineral oils from Sonneborn Inc., Paraffin oils of Petro Canada and vegetable oils from Cargill.

The term 'substantially non-polar' refers in the context of the present invention to a chemical entity that is overall non-polar even though it may contain some polarisable groups such as ester, hydroxyl group, and/or carboxyl group. The substantially non-polar carrier liquid is suitably selected from the group consisting of a mineral oil, In this invention, when is referred to a concentration of "liquid toner dispersion" it refers to a concentration wherein the liquid toner dispersion has a solid content so that it can be used as such in a digital printing process. In other words, the liquid toner dispersion according to the invention has a solid content that is at working strength and does not require a dilution. A typical solid content of liquid toner dispersion suitable for use in the printing process of the invention is a solid content of between 15 and 35 wt %, more preferably from 20 to 30 wt %, such as a solid content of 25 wt %. According to this invention, "solid content" means the amount of toner particles in wt % with regard to the total liquid toner dispersion. According to this invention, "excess liquid toner dispersion" is the liquid toner dispersion that remains present on the surface of a member, such as the developing member, after a part of liquid toner dispersion has been transferred to another member, such as the imaging member.

The term 'dispersing agent of the hyper-dispersant type' refers to a dispersing agent provided with anchor groups to which stabilising groups are coupled. Suitably examples of anchor groups of the dispersing agent are amine-functionalized polymers, such as polyalkyleneimines, for instance polyethyleneimine (PEI) and polyallylamines. The stabilizing groups of the dispersing agent are suitably chosen from the groups of fatty acid compounds and polyolefins, but similar groups are not excluded. The fatty acid compounds are for instance hydroxylated, and may be polymerized. A suitable degree of polymerization is for instance 2 to 10. Preferred examples of the stabilizing groups and the dispersing agent in its entirety have been described in Applicants' non-prepublished patent applications NL2011955 and NL2012086, which are herein included by reference. Alternatively, use may be made of commercially available dispersing agent, such as Solsperse™ 13940, Solsperse™ 11000, Oloa 11000, Solsperse J560 which again combine a polyamine anchor group with polymeric stabilizing groups. The residual amine functions in the amine functionalized backbone can also be partly or fully converted to small chain amides (like acetamide) or can be partially or fully alkylated or quaternized.

The term 'spacer agent' relates to an agent that is different from a dispersing agent and which spacer agent enables that the toner particles are kept at a minimum distance.

Use may be made of spacer agents that primarily comprise stabilizing moieties, such as used in the dispersing agent, however without any anchoring group. The stabilizing moieties of the spacer agent can therefore interact with the stabilizing and anchoring moieties of the dispersing agent. It is believed by the inventors that this interaction results in creating less attraction between the toner particles by elongation of the existing tails (stabilizing groups) of the dispersing agent ('DA-tails'), by creating inter-tail distortion by other conformational structures or by increasing the number of DA-tails without influencing the charging and/or fusing. This spacer agent typically comprises a polar head group which is essentially a single functional group (single site). Suitable examples of polar head groups are acids, such as carboxylic acid, sulphonic acids, anhydrides, such as succinic anhydride, amides and imide groups. The term 'tail' is used in the context of the present invention as a molecular part that is long on a molecular level and wherein the chemical function is primarily derived from its extension rather than the presence of specific functional groups. The tail of the spacer agent is preferably a polymer comprising a plurality of repetitive units with a weight-average molecular weight of less than 5000 g/mol, preferably in the range of 800-4000 g/mol. Suitably, the tail is based on a monomer compound comprising a carbon chain with at least one side chain. The monomer compound may contain an alkyl or alkylene group and optionally a carboxylic linking group. The carboxylic linking group is suitably an ester group. The alkyl- and alkylene chains are for instance prepared by combining saturated or unsaturated fatty acid, for instance C8-C26 fatty acids. Good results have been obtained with C16-C20 fatty acids, such as poly(hydroxy stearic acid) and poly(hydroxyricinoleic acid). More preferably, such polymers have a weight-average molecular weight in the range of 1200-3600 g/mol. Alternatively, use can be made of olefin, suitably based on a branched repetitive unit, such as isobutylene. The resulting polyolefin suitably has an average molecular weight in the range of 800-1800 g/mol. The dispersing agents in this invention can also be a decomposable dispersing agent. Such dispersing agent is described in the non-prepublished patent application NL2011064 in the name of Applicant, which is herein included by reference. Such a decomposable dispersing agent preferably comprises an anchoring group, a stimulus responsive part and a stabilizing part. The stimulus responsive part is herein suitably a photolabile group, which is suitably stimulated under irradiation with UV or infrared radiation. A suitable example is a diazene group or a benzoyl group. More specific examples of suitable photolabile groups are ortho-nitrobenzyl derivatives, a derivative of bis(2-nitrophenyl)methyl formate, a derivative of (E)-di(propan-2-yl)diazene, a benzoine derivative. Individual examples are mentioned in said patent application NL2011064.

The dispersing agent added in the course of the printing process may be different from the dispersing agent used for the preparation of the liquid toner dispersion.

The term 'low shear viscosity' is the viscosity when measured at 0.88 Hz at 25° C. The term is well-known in the engineering field and for instance mentioned by the ASTM International Standard body in relation to standard D7394, and is particularly relevant for composition containing polymers.

The electrical conductivity is measured with a field strength of $2.5\times10^6$V/m, and in a measurement cell with a first and a second electrode, applying a triangle wave voltage with a frequency of 10 Hz. The conductivity is defined as the current difference over the voltage difference, as multiplied by some constants relating to the measurement cell that will disappear in the relative conductivity. The term 'supernatant liquid' is the liquid obtained be centrifuge treatment. It is substantially carrier liquid but added thereto dissolved compounds and or small dispersed compounds, such as for instance free dispersing agent.

The term 'excess liquid toner dispersion' is the liquid that resides on or has been removed from a member, such as a development member, after a part of liquid toner dispersion has been transferred to another member, such as the imaging member. The 'liquid toner dispersion' is also known as a 'liquid developing dispersion'.

BRIEF DESCRIPTION OF THE FIGURES

These and other aspects of the invention will be further elucidated with reference to the figures, which are diagrammatical in nature and not drawn to scale and wherein.

DETAILED DISCUSSION OF ILLUSTRATED EMBODIMENTS

Figure 1:
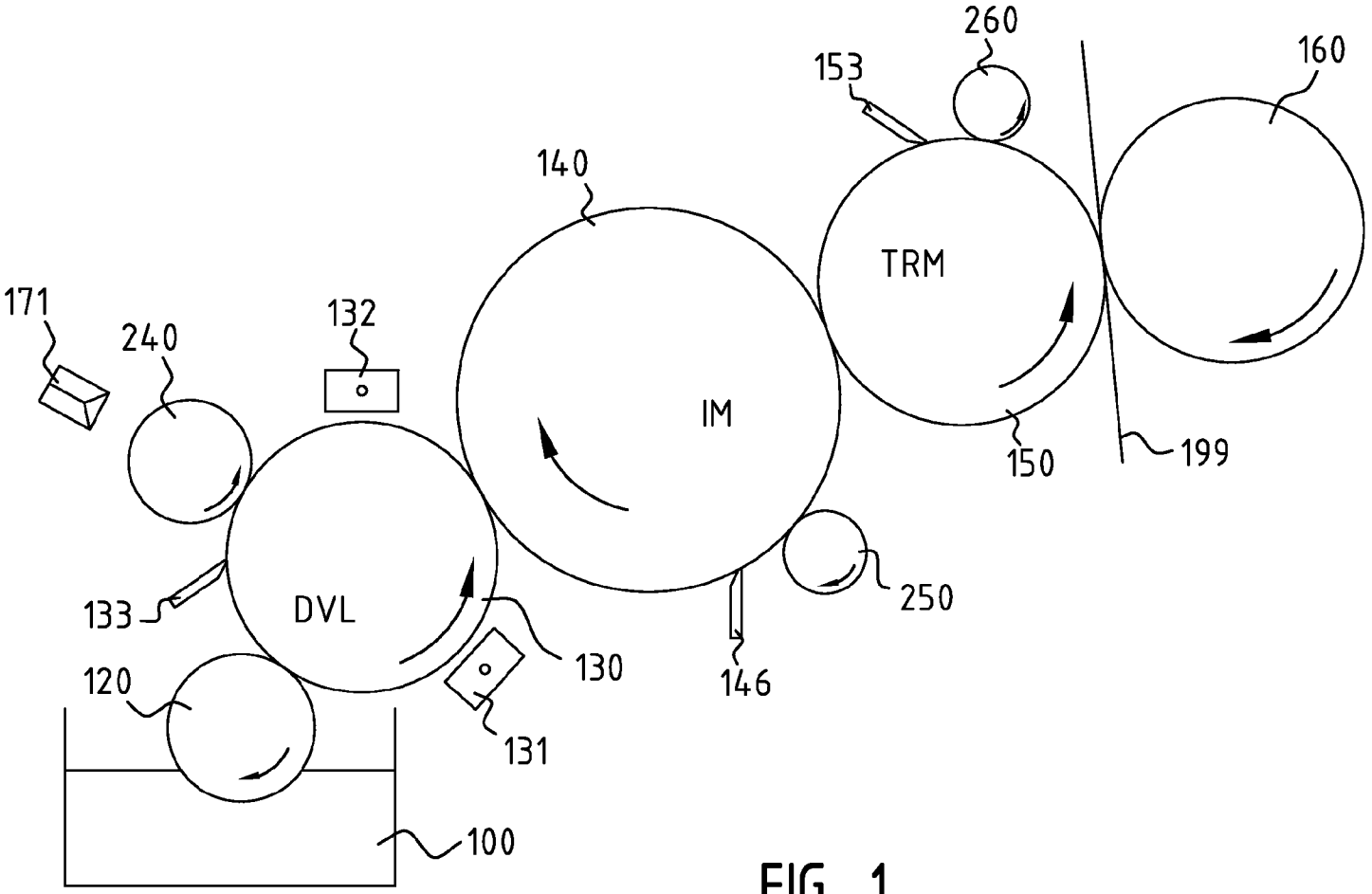
FIG. 1 is a schematic view illustrating a first embodiment of the invention.

The Figures are not drawn to scale and purely diagrammatical in nature. Equal reference numerals in different Figures refer to equal or corresponding features.

FIG. 1 illustrates diagrammatically a first embodiment of a digital printing apparatus of the invention, comprising a reservoir 100, a feed member 120, a toner member 130, an imaging member 140, a intermediate member 150 and a support member 160. A substrate 199 is transported between intermediate member 150 and support member 160. Both the development member 130 and the imaging member 140 and also the intermediate member 150 can function as the first member according to the invention, and are shown to be provided with a removal device 133, 146, 153, and with treatment means 132, 240; 250; 260. Without loss of generality, the aforementioned members are illustrated and described as rollers, but the skilled person understands that they can be implemented differently, e.g. as belts. Finally the substrate is fed to a fusing zone (not shown) to fix the image on the substrate.

In operation, an amount of liquid toner dispersion, initially stored in a liquid toner dispersion reservoir 100, also called main reservoir, is applied via a feed member 120, to a development member 130, an imaging member 140, and an optional intermediate member 150, and finally to a substrate 199. The development member 130, imaging member 140, and intermediate member 150 all transfer part of the liquid toner dispersion 100 adhering to their surface to their successor. The part of the liquid toner dispersion 100 that remains present on the member's surface, i.e. the excess liquid toner dispersion, which remains after selective, imagewise transfer, is removed after the transfer stage by appropriate means. The development member 130, the imaging member 140 and the intermediate member 150 may all act as the first member.

The charging of the toner on the development roll is done by charging device 131. This charging device can be a corona or a biased roll. By charging the toner the liquid toner dispersion splits into an inner layer at the surface adjacent of the development member 130 and an outer layer. The inner layer is more rich is toner particles and the outer layer is richer in carrier liquid.

Upon transfer of the liquid toner dispersion from the development member 130 to the imaging member 140, excess liquid toner dispersion is left on the development member 130. Ideally, this excess liquid toner dispersion is present only in "non-image" areas, i.e. areas not corresponding to the image to be printed on the substrate, which is specified by the imaging member. The physicochemical state and the rheology of the excess liquid toner dispersion are influenced by the charging and also by the concentration of the toner particles, which may have changed i.e. increased due to loss of carrier liquid during the development step. More particularly, the excess liquid toner dispersion is more concentrated and may shows caking. This transformation is due to the charging and to the transfer of part of the outer layer that is richer in carrier liquid.

FIG. 1 further shows a discharging corona 132 that is provided downstream of the area of the rotational contact between the toner roller 130 and the imaging roller 140. The discharging corona 132 is suitable for changing/removing the charge in the dispersion. Further, downstream of the discharge corona 132 there is provided an additional member 240. In this example, the additional member is embodied as a loosening roller, which is provided with a rubbing portion. The loosening roller 240 is, in use, in rotational contact with the development member 130. Similar loosening rollers 250, 260, which could be simply addition rollers without a dedicated rubbing portion, are present in rotational contact with the imaging member 140 and the intermediate member 150 respectively. Downstream thereof, a removal device is present, which most suitably is a scraper 133. The removed material is preferably recycled into fresh liquid toner.

Investigations have shown that several steps in the printing process are sensitive for failure, which may lead to errors in the image printed on the substrate, or to malfunctioning of the printing process. A first sensitive step is the charging step 131. Toner particles in the dispersion are aligned herein due to the charging by the charging device. Without a proper charging and alignment, the patterned transfer from the first member to the further member will not be adequate. The addition of dispersing agent to keep the toner dispersion within the desired range of relative viscosity and conductivity does not or not significantly interfere with this charging step.

A second sensitive step is the fusing of the liquid toner. This fusing is to result in coalescence of the toner particles on the paper. Typically use is made of a heat treatment that takes place shortly before, during or shortly after the transfer of the dispersion to the substrate. The term 'coalescence' refers herein to the process wherein toner particles melt and form a film or continuous phase that adheres well to the substrate and that is separated from any carrier liquid. Suitably, the carrier liquid is thereafter removed in a separate step, for instance by means of rollers, by means of blowing off the carrier liquid, by means of suction. Suitably, this process occurs at "high speed", for instance 50 cm/s or more, so as to enable high-speed printing. The fusing will avoid formation of an emulsion, since an emulsion does not give a good printing image because film formation is omitted. The addition of dispersing agent to keep the toner dispersion within the desired range of relative viscosity and conductivity does not or not significantly interfere with this filming behaviour at elevated temperature.

A third sensitive step is the removal of the liquid toner residue (excess liquid toner dispersion) which remains on the first member in the transfer step to the further member. This first member is preferably the development roller 130, but may alternatively be the imaging member 140 or the intermediate member 150. Particularly, toner particles in the liquid toner dispersion tend to form lumps in the dispersion resulting in a liquid with a non-uniform distribution of toner particles. This is called caking and often results in an increase of the viscosity of the liquid dispersion and partial jelly fractions of ink. This viscosity increase is significant and could be a tenfold increase or even more. The removal of the liquid toner residue starts then to be problematic. As a result, liquid toner residue could remain on the development roller, which constitutes a contamination and may lead to a non-uniform distribution of fresh toner dispersion resulting in a ghost image and or image quality that is not perfect, in other words incorrect. Examples of issues are density instability and incorrect reproduction of fine lines. The addition of dispersing agent to keep the toner dispersion within the desired range of relative viscosity and conductivity prevent to a large extent the formation of caking without having a negative impact on the printing process and/or the quality of the printed image.

In order to arrive at an improved printing process, the dispersion is a key element, and a difficult one. Modification of the dispersion typically influences its behaviour during charging, transferring and fusing. Modification of the dispersion also may have an impact on the behaviour of the liquid toner residue. Particularly, a dispersion that becomes unstable and inhomogeneous can give rise to a tremendous change in the rheology: a homogeneous dispersion mostly flows in its entirely, but the rheology of an inhomogeneous dispersion is in fact dependent on the two separate phases in the dispersion (the dispersed phase and the dispersing phase). In other words, the behaviour of a dispersion that becomes inhomogeneous is highly complex. The inventors have now found that a proper printing process may be obtained by controlling the liquid conductivity and the relative viscosity of the liquid toner dispersion during printing.

The relative conductivity is herein held between 0.5 and 30, more preferably between 0.7 and 20 and even more preferably between 0.9 and 15. The relative low shear viscosity is held between 1.25 and 225, more preferably between 1.5 and 150 and even more preferably between 2 and 100. Preliminary experimental data indicate excellent results between 2-25.

The relative conductivity (RC) is defined as the ratio between the electrical conductivity of the liquid toner dispersion (TC) and the conductivity of the supernatant liquid (SNC). The relative low shear viscosity (RLSV) is defined as the ratio of the low shear viscosities of of the liquid toner dispersion (TLSV) and the supernatant liquid (SNLSV). For sake of understanding it is added that the supernatant liquid will be mainly composed of carrier liquid into which dispersing agent and other additives may be dissolved. Carrier liquids based on mineral oils generally are electrically insulating and may have a conductivity of 0.1 (pS/cm) or less. The viscosity of the supernatant liquid generally corresponds to that of the carrier liquid.

In a suitable embodiment of the invention, the liquid conductivity (i.e. that of the supernatant liquid (SNC)) is used as an additional parameter. Possibly, this liquid conductivity is used as an alternative to the relative conductivity. In fact, both parameters of relative and liquid conductivity have an overlapping meaning and significance.

The physical meaning of the relative conductivity is understood by the inventors to express primarily the sensitivity of the liquid toner dispersion for charging and therewith the quality of transfer and compaction and final image sharpness. A low quality of transfer has the risk that the fraction of all toner particles in areas according to the image that end up at the substrate is too low, and or that the transfer of patterns is not fully correct. These phenomena tend to contribute to printing errors, such as edge effects, low density and noisy images.

The physical meaning of the liquid conductivity is understood by the inventors to express primarily the barrier against fusing of the particles, in view of a good colloidal stability of the toner particles. A large amount of dispersing agent contributes to this colloidal stability and therewith resistance against fusing and collapse or coalescence of the individual toner particles. As is apparent from the results, a liquid conductivity that is too high, corresponds to fusing problems. A significant lowering of the liquid conductivity relative to its initial value (for a specific liquid toner dispersion) moreover likely indicates an increased risk for caking. The significant lowering is for instance at least 33%, for instance at least 40% or even around 50%. However, this is rather a monitoring value than an absolute value independent of the specific toner dispersion.

Figure 2:
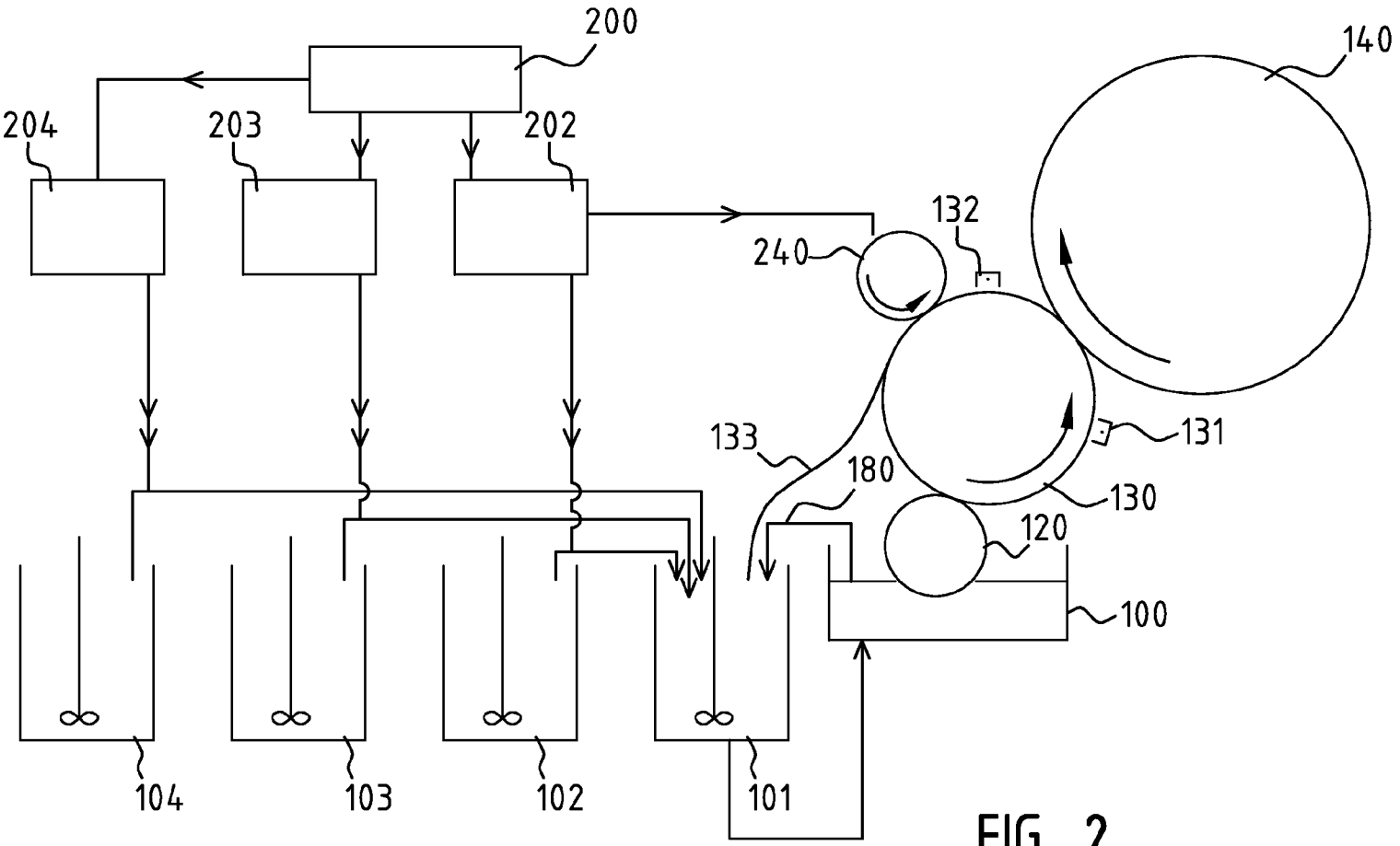
FIG. 2 is a schematic view illustrating a second embodiment of the invention.

FIG. 2 shows in schematical view a further embodiment of the invention. This figure indicates a layout comprising several containers 101-104 and several addition means 202-204. The containers are those for dispersing agent or composition thereof (102), carrier liquid (103) and toner concentrate (104). The addition means 202-204 are configured for addition of composition from the containers 102-104 to a first container 101 under control of a controller 200. The contents of the first container, which will be stirred adequately, is then added into the toner container 100. Additionally, feedback means 180 are present so as to feed liquid toner dispersion from the toner container 100 into the first container 101. This feedback means 180 may be embodied as an overflow mechanism, but may alternatively be arranged by means of a valve. One advantage hereof is the control of the liquid level in the toner container 100. A further advantage is that such feedback stabilizes the mixing process in first container 101, i.e. to ensure that the composition of the liquid toner dispersion remains and/or is brought to a predefined value.

According to the shown embodiment, both charging means 131 and treatment means for facilitating removal are present. The latter treatment means comprise in this example decharging means 132 and an additional member 240 for adding a composition of dispersing agent (DA). In this example, The DA composition that is added to the additional member 240, is taken from the DA container 202. This occurs again under control of a controller 200.

This control unit will assure that the solid content of the toner liquid dispersion 101 will be in the desired range, for example a setpoint ±2%, more preferably ±1.5% and also that the relative conductivity (RC) and the relative low shear viscosity (RLSV) are kept within the desired range to obtain stable print quality and good fusing quality.

The control means may also control, that the charging means 131 and the decharging means 132 are switched off upon an interruption of the printing process. Furthermore, the control means ensures that the development member 130 is separated and isolated from the imaging member 140 upon interruption, such that the development member 130 may continue to rotate without transfer of liquid toner to the imaging member 140. Such a separation or isolation may be achieved in known manner. The isolation and separation may further comprise switching off an electric field operating at the imaging member 140 and/or at a nip where development member 130 and imaging member 140 contact each other. An electric field, if any, between the feed member 120 and the development member 130 can also be switched off.

It will be understood that the above sequence of tanks is deemed an advantageous configuration that may also be used in combination with the embodiments shown in FIGS. 1 and 2. Alternatively configurations are however not excluded.

Figure 3:
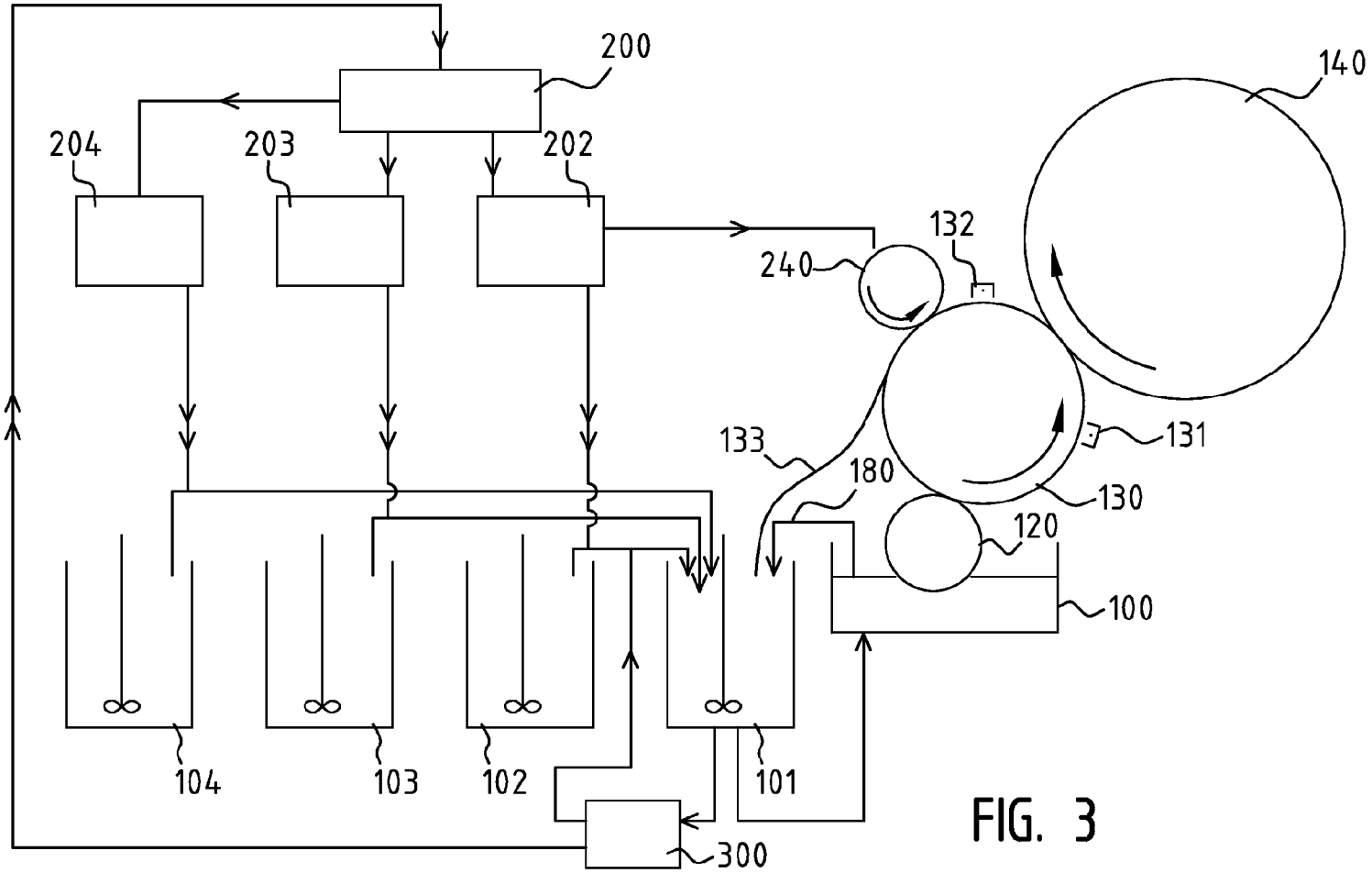
FIG. 3 is a schematic view illustrating a third embodiment of the invention.

FIG. 3 shows a further embodiment that differs from the embodiment shown in FIG. 2 in the addition of sensor means 300 in bypass with the container of the liquid toner dispersion 101. The sensor means may contains a sensor to monitor the solid content, the viscosity and the conductivity. Based on these signals the control means 200 will control the addition means CA 204, LA addition means 203 and DA addition means 202 to adjust the solid content and the RC and RLSV in the appropriate ranges.

EXAMPLES

Test System

A printing test was carried out on an apparatus as shown in FIG. 2. However, the dispersing agent was added directly into the tank 101 for a DA container 102, rather than on roller 240 for 2 hours by printing a test file with a page coverage of 15% on a substrate (115 gsm Digifinesse™—a brand of UPM). The page coverage is defined as the ratio between image area and total area of the test file. The solid content of the liquid toner dispersion in tank 101 was kept in a range between 23 and 26% during the printing test by adding the carrier liquid from tank 103 and toner concentrate from tank 104 in appropriate flows. The engine was running at 60 cm/s and the applied mass of liquid toner on member 130 was between 4.5 and 6.5 g/m$^2$. The charging 131 was operated so that the surface potential just after charging was between 25 and 40V measured with a surface potential measurement device.

The sample was fused on a fuser device comprising non-contact fusing means provided with NIR (near infrared) carbon lamps followed by a contact fusing means embodied as 16 pairs of hot rollers. The output of the carbon lamps was adjusted so that the non printed substrate temperature directly after the non contact fusing is between 65 and 70° C. The roll temperature of the first 8 pairs of fusing rollers is set at 80° C. and the next 8 pairs of hot roller were set at 130° C. The fusing level was ranked relatively against fusing quality of a reference on the basis of a tape test. The outcome of the tape test for the fresh liquid toner dispersions LD1-LD6, which was good, was used as a reference for the evaluation of the tape tests with liquid toner dispersions LD1-LD6 after 120 minutes and optional addition of dispersing agent. The ranking is:

1: same fusing quality as the reference toner dispersion

2: fusing quality slightly worse than that of the reference toner dispersion but still acceptable 3: unacceptable fusing quality The caking level is evaluated by visual inspection of the toner on the scraper blade 133 and ranked as follows:

0 refers to no caking, meaning that a very good result is obtained.

1, 2, or 3 refers to caking levels where small acceptable amounts of caking occurs, where 1 refers to a good result, 2 refers to a moderate result, and 3 refers to a result that is just acceptable.

4 refers to a caking level that is not acceptable.

5 refers to severe caking.

Test Methods

Conductivity Measurement

The measuring device comprises a cell with a first and a second electrode with a surface of 5 cm$^2$ separated by a gap of 80 μm. The plates are a temperature of 25° C. A triangle wave of voltage is applied between the plates with a frequency of 10 Hz by a Keitley KE2636A device. The electric field applied between the electrodes is $2.5\times10^6$V/m. The responding electrical current is measured and conductivity is determined as $$\text{Conductivity}=(\Delta\text{current}/\Delta\text{voltage})*(\text{gap/surface electrode})$$ and is expressed in pS/cm.

The abbreviation 'SNC' is herein used to refer to the electrical conductivity measured on the supernatant of the liquid toner dispersion (prepared as described below).

Viscosity

The viscosity of the liquid toner dispersion and supernatant liquid is measured with a Haake Rheostress RS6000 operated in shear rate sweep from 0.1 to 30001/s at 25° C. and expressed in mPas. The instrument is equipped with a cone/plate geometry type C60/1° and the gap is set to 0.052 mm.

The abbreviation SNLSV is used hereinafter to refer to the low shear viscosity of the supernatant measured at a shear rate of 0.88 l/s. The abbreviation TLSV is used hereinafter to refer to the low shear viscosity of the liquid toner dispersion measured at a shear rate of 0.88 l/s.

Supernatant Liquid

The supernatant liquid is obtained by putting the liquid toner dispersion in a Beckman centrifuge type microfuge 16 at 15,000 RPM for 1 hour followed by separating the liquid (=supernatant liquid) from the sediment. The setting of 15,000 RPM corresponds to a relative centrifugal force (RCF) of approximately 15,000 g.

Tapetest

A tapetest is performed according the FINAT test method no 21 (see www.finat.com). Use is made of 3M Scotch 810 Magic tape.

Liquid Toner Dispersions

A liquid toner dispersion comprising a toner particle, a carrier liquid and a dispersing agent is prepared. The ingredients used to prepare the toner particles and the liquid toner dispersions are summarized in Table 1.

TABLE 1

| ingredients | | |
|---|---|---|
| | Name | Description |
| Polymer | PM1 | polyester resin with an acid value of 12 mg KOH/g, a Tg of 60° C. (1) and a Tm of 99.8° C. (1) |
| Additive | AD1 | Toluene sulfonamide |
| Pigment | PIG1 | PB15.3 |
| | PIG2 | PR148 + PR57.1 |
| | PIG3 | PY185 |
| | PIG4 | PBlack 7 |
| Dispersing Agent | DA1 | polymeric dispersing agents with a polyethylenimine backbone and polyhydroxystearate grafts having a base equivalent (2) of 560-620 |
| Liquid | LIQ1 | mineral oil having a viscosity of 5 mPas measured at 1 Hz at 25° C. |
| | LIQ2 | mineral oil having a viscosity of 17.5 mPas measured at 1 Hz at 25° C. |
| | LIQ3 | mineral oil having a viscosity of 1.7 mPas measured at 1 Hz at 25° C. |

(1) measured according to ASTM D3418

(2) the amount of dispersing agent that is needed to neutralize 1 mol of acid

Table 2 shows the composition of the toner particles. The toner particles are prepared by kneading the ingredients of Table 2 at a temperature of 100 to 120° C. for 45 minutes. This mixture is cooled down and milled down to obtain particles with a size of about 10 μm using a fluidized bed mill.

TABLE 2

| Composition of toner particles | | | | | | |
|---|---|---|---|---|---|---|
| | polymer | | Pigment | | Additive | |
| | Name | conc (w/w %) | name | conc (w/w %) | name | conc (w/w %) |
| MAR1 | PM1 | 81.5 | PIG1 | 12.5 | AD1 | 6 |
| MAR2 | PM1 | 79 | PIG2 | 15 | AD1 | 6 |
| MAR3 | PM1 | 79 | PIG3 | 15 | AD1 | 6 |
| MAR4 | PM1 | 81.5 | PIG4 | 12.5 | AD1 | 6 |

Subsequently, a liquid toner dispersion having the composition as indicated in Table 3 is prepared. A pre-dispersion of the ingredients shown in Table 3 is prepared by stirring the ingredients during 10 minutes at room temperature. The pre-dispersion is brought into a liquid milling device. The liquid toner dispersion is milled down with a bead mill type PML2 from Buhler AG with a tip speed of 5 to 9 m/s to a obtain a volume based median particle size (dv50) of 1.5 to 2.5 μm. The milling was continued until particles with the desired particle size, viscosity and conductivity were obtained.

TABLE 3

| liquid toner dispersion concentrate composition | | | | | | |
|---|---|---|---|---|---|---|
| | toner particles | | dispersing agent | | carrier liquid | |
| | type | amount (wt %) | type | amount (wt %) | liquid | amount (wt %) |
| LD1 | MAR1 | 35 | DA1 | 3 | LIQ1 | 62 |
| LD2 | MAR2 | 35 | DA1 | 2.8 | LIQ1 | 62.2 |
| LD3 | MAR3 | 35 | DA1 | 3 | LIQ1 | 62 |
| LD4 | MAR4 | 35 | DA1 | 2.7 | LIQ1 | 62.3 |
| LD5 | MAR1 | 35 | DA1 | 3.2 | LIQ2 | 61.8 |
| LD6 | MAR1 | 35 | DA1 | 2.8 | LIQ3 | 62.2 |
| LD7 | MAR1 | 35 | DA1 | 4 | LIQ1 | 61 |
| LD8 | MAR1 | 35 | DA1 | 2.5 | LIQ1 | 62.5 |

LD7 is prepared in the same manner as LD1 but with a higher content of dispersing agent (DA) resulting in a toner with the same particle size but the toner has a higher supernatant conductivity (SNC).

LD8 is also prepared in the same manner as LD1, but with a lower concentration of dispersing agent (DA) resulting in a liquid toner dispersion with the same particle size but with a higher low shear viscosity (TLSV).

Results

The inventors performed a printing test using liquid toner LD1 to LD8 in diluted form, having a solid content (SC) of 25% in the test system as described above. The low shear viscosity and conductivity of the supernatant liquid and of the liquid toner dispersion were determined at the beginning of the test and at the end of the test, i.e. after 2 hours. Printing went on continuously and uninterrupted during these 2 hours.

In the course of the test, a composition of dispersing agent was added from a tank of dispersing agent to the toner container. The addition occurred every 2 minutes in a predefined amount. In this test, used was made of the dispersing agent DA1 as listed in Table 1. Different amounts of dispersing agent were added, in increasing amounts (in the order A<B<C). It is observed that the amounts A, B and C are toner specific.

Results are given in Tables 4-6. Table 4 herein shows the results obtained at the beginning of the test. Table 5 and Table 6 show the results obtained at the end of the test. The results in Tables 5 and 6 were obtained with different amounts of dispersing agent added.

It can be inferred from the Tables 4-6 that the added amount of dispersing agent directly influences the supernatant conductivity (SNC), the relative low shear viscosity and the relative conductivity. If this SNC increases too much, relative to its initial value, the fusing is not appropriate. If this SNC decreases significantly, relative to its initial value, caking occurs. There is therefore a regime, wherein the concentration of dispersing agent in the main tank 101 remains relatively constant, so as to obtain appropriate results.

It is further observed that this concentration is dependent on a variety of factors. As can be understood on the basis of the ingredients, the amount of dispersing agent and the type of carrier liquid in the toner has an impact on the required concentration. Furthermore, the type of pigment has an impact on the required concentration. Therefore, the relevant parameter for fusing behavior, wherein the forming of an emulsion is to be prevented, is a measure of both the conductivity and the low shear viscosity of the supernatant liquid.

From Tables 4, 5 and 6, it is clear that a liquid toner dispersion is to be used and to be maintained according to the invention. A liquid toner dispersion outside the specified range creates problems. Unexpectedly this was observed to be colour independent showing the intrinsic value of these ranges. This is true both for liquid toner dispersions regardless of whether the liquid conductivity or relative viscosity is outside the specified range before start of the printing process (LD7, LD8) or gets outside the specified range during the printing process (LD1a,c,d, LD5a,c,d).

TABLE 4 results for the fresh liquid toner dispersions

| ex | toner | TC pS/cm | SNC pS/cm | TLSV mpas | SNLSV mPas | RLSV = TLSV/SNLSV | RC = TC/SNC | Caking | fusing |
|---|---|---|---|---|---|---|---|---|---|
| 1 | LD1 | 6.46 | 2.51 | 21 | 5.2 | 4.0 | 2.6 | 1 | 1 |
| 2 | LD2 | 20.3 | 2.75 | 20 | 5.2 | 3.8 | 7.4 | 1 | 1 |
| 3 | LD3 | 0.72 | 0.19 | 52 | 5.2 | 10.0 | 3.8 | 1 | 1 |
| 4 | LD4 | 1.95 | 0.45 | 28 | 5.2 | 5.4 | 4.3 | 1 | 1 |
| 5 | LD5 | 3.23 | 1.02 | 86 | 18.3 | 4.7 | 3.2 | 1 | 1 |
| 6 | LD6 | 7.8 | 3.7 | 14 | 2 | 7.0 | 2.1 | 1 | 1 |
| 7 | LD7 | 15.4 | 39 | 12 | 5.3 | 2.3 | 0.39 | 1 | 3 |
| 8 | LD8 | 2 | 1 | 1245 | 5.2 | 239.4 | 2 | 4 | 1 |

TABLE 5 test results obtained after 2 hours printing and regularly adding an appropriate amount of dispersing agent.

| ex | toner | TC pS/cm | SNC pS/cm | TLSV mpas | SNLSV mPas | RLSV = TLSV/SNLSV | RC = TC/SNC | caking | fusing |
|---|---|---|---|---|---|---|---|---|---|
| 1b | LD1 | 5.3 | 2.3 | 43 | 5.2 | 8.3 | 2.3 | 2 | 1 |
| 2b | LD2 | 22.1 | 4.9 | 18 | 5.2 | 3.5 | 4.5 | 1 | 2 |
| 3b | LD3 | 1.05 | 0.42 | 35 | 5.2 | 6.7 | 2.5 | 1 | 1 |
| 4b | LD4 | 1.65 | 0.55 | 35 | 5.2 | 6.7 | 3 | 2 | 2 |
| 5b | LD5 | 4.3 | 1.25 | 79 | 18.3 | 4.3 | 3.4 | 1 | 2 |
| 6b | LD6 | 8.1 | 3.5 | 16 | 2 | 8.0 | 2.3 | 1 | 1 |

TABLE 6 test results obtained after 2 hours printing and regularly adding amounts of dispersing agent

| ex | Toner | DA addition | SNC pS/cm | TLSV mpas | SNLSV mPas | RLSV = TLSV/SNLSV | RC = TC/SNC | caking | fusing |
|---|---|---|---|---|---|---|---|---|---|
| 1a | LD1 | 0 | 1 | 1900 | 5.2 | 365.4 | 3.9 | 5 | 1 |
| 5a | LD5 | 0 | 0.27 | 4730 | 18.3 | 258.5 | 2.0 | 5 | 1 |
| 1b | LD1 | B | 2.3 | 43 | 5.2 | 8.3 | 2.3 | 2 | 1 |
| 5b | LD5 | B | 1.25 | 79 | 18.3 | 4.3 | 3.4 | 1 | 2 |
| 1c | LD1 | A | 1.3 | 1410 | 5.2 | 271.2 | 3.2 | 4 | 1 |
| 5c | LD5 | A | 0.38 | 2820 | 18.3 | 154.1 | 6.7 | 4 | 1 |
| 1d | LD1 | C | 23 | 17 | 5.2 | 3.3 | 0.47 | 1 | 3 |
| 5d | LD5 | C | 12.6 | 57 | 18.3 | 3.1 | 0.41 | 1 | 3 |

Comparative Example

HP Indigo™ ElectroInk 3000, as used on all HP Indigo digital printing apparatus, is a commercially available liquid toner dispersion comprising electrically conductive toner particles and having solid content of approximately 20% by weight. This is a paste that is too viscous and not suitable for printing. A further dilution to 5 wt % with Isopar L as carrier liquid resulted in a liquid toner dispersion with a viscosity suitable for printing. The resulting toner conductivity (TC) was 100 pS/cm and the conductivity of the supernatant liquid was 0.8 pS/cm. The relative conductivity was thus 125 and outside the range according to the invention.

The same Indigo™ ElectroInk was thereafter diluted with HP imaging oil for use in HP Indigo Press series 3000 as commercially available from HP, and comprising petroleum hydrocarbon (90-100 wt %). The degree of dilution is to 5%. The resulting toner conductivity (TC) was 175 pS/cm and the conductivity of the supernatant liquid (SNC) was 2.75. The relative conductivity (RC) is then 64. This is outside the range according to the invention.

Further Example

A further liquid developer dispersion is prepared that comprises toner particles, carrier liquid and dispersing agents. The ingredients used are the PM1, AD1, DA1, LIQ1 listed in Table 1. The toner particle MARL was used. A pre-dispersion was prepared and milled in a liquid milling device. Although the milling was done in a different manner than described above, to arrive at a similar median particle size dv50 of 1.5 to 2.5 μm. Concentrated liquid toner dispersions were obtained with following composition

TABLE 7

| Composition of liquid developer dispersion | | | | | | |
|---|---|---|---|---|---|---|
| | Marking particles | | Dispersing agent | | Carrier liquid | |
| Name | Name | Conc (wt % | | Conc ( )wt % | | Conc wt % |
| LD9 | MAR1 | 35 | DA1 | 3.5 | LIQ1 | 61.5 |

2.2 Printing Test

A printing test was performed with liquid developer dispersion LD9 in a printer having a setup as illustrated in FIG. 2. LD 9 was first diluted to obtain a solid content of 25 wt %. The excess liquid developer dispersion (in table 8 mentioned as LD9 caking) was collected using removal means. A dispersion composition comprising free dispersing agent was added to the excess liquid developer dispersion, at different concentrations which can be found in Table 8. In some cases the excess liquid developer dispersion is diluted to a solid content of 25 wt % after DA1 has been added (sample 4 and 5). The concentration of DA that is added is given in wt % with regard to the weight of excess liquid developer dispersion before it is diluted or concentrated. The conductivity was measured with an electrical field strength of $1.25\times10^6$V/m.

Sample 3 herein has a relative low shear viscosity that is above the range of the invention. This corresponds to the observation in Table 8, that the sample represents caked material that is diluted, and as such not directly suitable for use as liquid toner dispersion to be fed onto a development member.

Samples 4 and 5 show a recycled liquid toner dispersion having a conductivity and a low shear viscosity in the same range as that of the starting liquid toner dispersion. Therefore, a liquid toner dispersion of the invention provided with a relative conductivity and a relative low shear viscosity within the range of the invention.

The invention claimed is:

1. A liquid toner dispersion comprising toner particles in a substantially non-polar carrier liquid, which liquid toner dispersion has a solid content of between 15 and 35 wt %, wherein the liquid toner dispersion is intrinsically uncharged and has a relative conductivity between 0.5 and 30, and a relative low shear viscosity between 1.25 and 225, wherein the relative conductivity and relative low shear viscosity are defined as a ratio of the conductivities and low shear viscosities of a liquid toner dispersion and a supernatant liquid obtained in centrifugation of the liquid toner dispersion.

TABLE 8

| Properties of collected excess liquid developer dispersion | | | | | |
|---|---|---|---|---|---|
| Sample | Liquid developed dispersion | Comment | Solid Content (%) | Toner Conductivity (pS/cm) | Rheology (mPas) 0.88/s |
| 1 | LD9 | Starting liquid developer dispersion | 25 | 1.15 | 180.00 |
| 2 | LD9-caking | Removed caking at printing average 5-20% page coverage | 40 | | |
| 3 | LD9-diluted caking | LD1-caking diluted to 25% SC with carrier liquid | 25 | 0.56 | 1230.00 |
| 4 | (LD9-caking + 0.15% DA1) diluted to 25% | LD1-caking to which 0.15% DA1 is added and afterward diluted to 25% SC | 25 | 1.26 | 446.00 |
| 5 | (LD9-caking + 0.2% DA1) diluted to 25% | LD1-caking to which 0.2% DA1 is added and afterward diluted to 25% SC | 25 | 1.32 | 195.00 |

The conductivities and low shear viscosities have merely been mentioned in the table above for those compositions with a solid content of 25 wt %, for sake of comparison.

While the conductivity (SNC) and the low shear viscosity (SNLSV) of the supernatant liquid were not measured in the above mentioned examples, the SNLSV will have been roughly equal to that of LD1, 5.2 mPas, and the SNC will have been in the range between the conductivity of the carrier liquid, 0.2 pS/cm and the toner conductivity.

Table 9 shows the resulting relative conductivities and low shear viscosities.

| Sample | TC | SNC | RC | TLSV | SNSLV | RLSV |
|---|---|---|---|---|---|---|
| 1 | 1.15 | 0.2-1.15 | 1-6 | 180 | 5.2 | 35 |
| 3 | 0.56 | 0.2-0.6 | 1-3 | 1230 | 5.2 | 237 |
| 4 | 1.26 | 0.2-1.26 | 1-7 | 446 | 5.2 | 86 |
| 5 | 1.32 | 0.2-1.32 | 1-7 | 195 | 5.2 | 38 |

The values of the relative conductivity (RC) are herein also indicative, due to the estimated value for the SNC.

2. The liquid toner dispersion as claimed in claim 1, wherein the conductivity of the supernatant liquid (SNC) is smaller than 20 pS/cm, when measured in an electrical field of $2.5\times10^6$ V/m.

3. The liquid toner dispersion as claimed in claim 1, wherein the toner particles have an average diameter in the range of 0.5 and 2.5 micrometer.

4. The liquid toner dispersion as claimed in claim 1, wherein the toner particles comprise pigment mixed with a binder resin and a dispersing agent.

5. The liquid toner dispersion as claimed in claim 4, wherein the dispersing agent is of the hyper-dispersant type comprising an anchor group for binding to a toner particle and stabilizing groups coupled to said anchor group for stabilizing said toner particle in the carrier liquid.

6. The liquid toner dispersion as claimed in claim 5, wherein the anchor group comprises an amine-functionalized polymer.

7. The liquid toner dispersion as claimed in claim 1, wherein the dispersion further comprises a dispersing agent separate from the toner particles.

8. The liquid toner dispersion as claimed in claim wherein the dispersion further comprises a spacer agent.

9. A digital printing process for transferring an image to a substrate, comprising the steps of:

providing an intrinsically uncharged liquid toner dispersion comprising toner particles in a substantially non-polar carrier liquid and having a solid content from 15 to 35 wt % into a toner container from a first mixing container;

feeding liquid toner dispersion from the toner container to a development member, followed by charging and then transferring to a further member according to a desired pattern under the impact of an electric field;

removing liquid toner dispersion remaining on the development member from the development member and recycling into the first mixing container, said first mixing container being adapted for collecting excess liquid toner dispersion;

maintaining the liquid toner dispersion in the toner container to have a relative conductivity between 0.5 and 30, and a relative low shear viscosity between 1.25 and 225, in which the relative conductivity and relative low shear viscosity are defined as a ratio of the conductivities and low shear viscosities of a liquid toner dispersion and a supernatant liquid obtained in centrifugation of the liquid toner dispersion.

10. The digital printing process as claimed in claim 9, wherein the liquid toner dispersion is maintained in the toner container with a tolerance limit of a predefined toner concentration.

11. The digital printing process as claimed in claim 9, wherein the maintenance of the liquid toner dispersion comprises the addition of dispersing agent.

12. The digital printing process as claimed in claim 11, wherein the dispersing agent is added to excess liquid toner dispersion remaining on the development member.

13. The digital printing process as claimed in claim 9, wherein a discharging treatment is applied to the liquid toner dispersion remaining on the development member.

14. The digital printing process as claimed in claim 9, wherein the adding means are arranged for adding an amount of dispersing agent into the first container.

15. The digital printing process as claimed in claim 11, wherein use is made of a system with a second reservoir, adapted for mixing the excess liquid toner dispersion in which the amount of dispersing agent is added, with carrier liquid.

16. The digital printing process as claimed in claim 15, wherein the excess liquid toner dispersion is further mixed with toner concentrate.

* * * * *